US007146115B2

(12) United States Patent
Suzuki et al.

(10) Patent No.: US 7,146,115 B2
(45) Date of Patent: Dec. 5, 2006

(54) IMAGE FORMING APPARATUS AND DEVELOPING-AGENT AMOUNT DETECTING METHOD, CARTRIDGE, AND STORAGE MEDIUM

(75) Inventors: Tatsuya Suzuki, Shizuoka (JP); Nobuharu Hoshi, Shizuoka (JP); Kanji Yokomori, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 10/995,751

(22) Filed: Nov. 23, 2004

(65) Prior Publication Data

US 2005/0117922 A1 Jun. 2, 2005

(30) Foreign Application Priority Data

Nov. 28, 2003 (JP) ..... 2003-399882
Oct. 27, 2004 (JP) ..... 2004-312302

(51) Int. Cl.
*G03G 15/08* (2006.01)

(52) U.S. Cl. ..... 399/27; 399/61

(58) Field of Classification Search ..... 399/27, 399/61, 30, 82, 62
See application file for complete search history.

(56) References Cited

U.S. PATENT DOCUMENTS 6,343,193 B1 1/2002 Matsumoto et al.
6,347,198 B1 * 2/2002 Yamamoto et al. ..... 399/27
6,785,479 B1 8/2004 Naito et al.
6,947,681 B1 * 9/2005 Ogata ..... 399/61
2003/0165344 A1 9/2003 Ohtomo et al.

FOREIGN PATENT DOCUMENTS

JP 10-133544 5/1998
JP 10-186822 7/1998
JP 2000-131936 5/2000

* cited by examiner

*Primary Examiner*—Susan Lee
(74) *Attorney, Agent, or Firm*—Canon U.S.A., Inc. Intellectual Property Division

(57) ABSTRACT

An image forming apparatus having a first operating mode and a second operating mode, where the second operating mode has an image forming velocity different from that in the first operating mode. The image forming apparatus includes a developing-agent containing portion, which contains a developing agent, an optical developing-agent amount detecting portion, which detects the amount of developing agent in the developing agent containing portion, a processing portion, which obtains the amount of developing agent based on data on the amount of developing agent detected by the developing-agent amount detecting portion, and a storing portion, which stores information for correcting data on the amount of developing agent detected by the developing-agent amount detecting portion in the second operating mode. The processing portion corrects the data on the amount of developing agent detected by the developing-agent amount detecting portion in the second operating mode based on the information stored in the storing portion, and obtains the amount of developing agent based on the corrected data.

28 Claims, 11 Drawing Sheets

IMAGE FORMING APPARATUS AND DEVELOPING-AGENT AMOUNT DETECTING METHOD, CARTRIDGE, AND STORAGE MEDIUM

BACKGROUND OF THE INVENTION

1. Field of the Invention

The present invention relates to an image forming apparatus, such as a copying machine or a printer, using an electrophotographic method and a developing-agent amount detecting method, a cartridge used for the image forming apparatus, and a storage medium attached to the cartridge.

2. Description of the Related Art

Hitherto, an image forming apparatus such as a copying machine, a printer, or a facsimile machine develops an electro-static image which is formed on an image carrying member, such as an electrophotographic photosensitive member, by using a developing device and visualizes a developing-agent (hereinafter, referred to as toner) image.

The image forming apparatus, using the electrophotographic image forming process, uses a processing cartridge method by which the electrophotographic photosensitive member and processing means that operates to the electrophotographic photosensitive member are integrally used as a cartridge. The cartridge is detachable from the image forming apparatus. Further, the developing device used as a cartridge is put into practical use. According to the processing cartridge method, the user maintains the apparatus and therefore the operability is improved.

As one method for improving the usability of the processing cartridge, various technologies for detecting the remaining amount of toner for sending a notification indicating the remaining amount of toner of the processing cartridge to the user are well known. One of the well-known technologies for detecting the remaining amount of toner is a light-transmission-type method for detecting the remaining amount of toner and for measuring the transmission time of light that passes through a toner container for a predetermined time (refer to, e.g., Japanese Patent Laid-Open No. 10-186822 with reference to p. 6, FIGS. 7 to 8).

As the structure of the light-transmission-type method for detecting the remaining amount of toner, the image forming apparatus comprises a light emitting unit and a light receiving unit, a light-transmitting window is arranged to a toner container, a light guide introduces detected light between the light-transmitting window and the light emitting unit and light receiving unit, and the detected light passes through the toner container. The toner container has a stirring member which stirs the toner by rotating. In this case, when the remaining amount of toner is large and the stirring member is rotated, the toner shields the detected light. Thus, the detected light does not reach the light receiving unit. On the contrary, when the remaining amount of toner is small, the toner does not shield the light, and the light receiving unit detects the light. Since the time for light transmission in the toner container depends on the remaining amount of toner, the remaining amount of toner in the toner container is estimated by measuring the light-receiving time per rotation of the stirring member.

A signal processing unit samples an output waveform of an analog signal detected by the light receiving unit at a predetermined sampling interval. The signal is subjected to digital processing based on a predetermined threshold, and the light-detecting time per rotation of the stirring member is outputted as a pulse width. A relationship between the remaining amount of toner and the pulse width is checked in advance, thereby calculating the remaining amount of toner based on the pulse width. The relationship between the remaining amount of toner and the pulse width is stored in the image forming apparatus as a reference table or operation formula. In the light-transmission-type toner remaining-amount detection, in order to improve the precision thereof, the remaining amount of toner is calculated by a statistical method using statistical processing (refer to e.g., Japanese Patent Laid-Open No. 10-186822 with reference to p. 6, FIGS. 7 to 8).

The image forming apparatus needs to transfer and fix a toner image on various transfer members such as a thick sheet or OHT so as to form the image, and therefore has a plurality of printing modes having best sheet conveying velocities. In this case, a rotating velocity of the stirring member arranged in the processing cartridge is simultaneously changed. Thus, the rotating velocity of the stirring member in the toner container is changed. The absence of toner remaining-amount is accurately detected even when the rotating velocity of the stirring member changes. Therefore, in the image forming apparatus having a plurality of printing modes having different rotating velocities, a relationship between the light-transmission time corresponding to the rotating velocity and a threshold for determination of the absence of toner is obtained in advance (refer to Japanese Patent Laid-Open No. 2000-131936 with reference to p. 7, FIG. 3).

Recently, the processing cartridge has included a storage device. The main body of the image forming apparatus communicates information on image quality, manufacturing of processing cartridge, life of a member forming the processing cartridge, information on the used amount of toner, and information on operating status of the main body with the storage device. Thus, the maintenance of image forming apparatus or processing cartridge is easy and the usability is improved (refer to, e.g., Japanese Patent Laid-Open No. 10-133544 with reference to p. 10, FIG. 1).

However, the rotating period of the stirring member is usually between 0–10 RPM. As compared with the printing time of one transfer sheet, which is determined depending on the printing velocity of the image forming apparatus, in the case of the printing time of one printing sheet, the number of rotations of the stirring member is one to two RPM. Therefore, in the image forming apparatus having a plurality of printing velocities, in the image forming processing at varied printing velocities depending on one sheet, the stirring velocity of the stirring member is changed depending on the printing velocity of every sheet. The output waveform of the remaining amount of toner is sampled at a predetermined interval and then data for statistical processing every sheet has different-type data and thus an inaccurate value is calculated as the final remaining amount of toner.

The fluidity of toner varies depending on the printing velocity. Therefore, the light-transmission time changes in inverse-proportion to the rotating velocity. Further, upon changing the rotating velocity of the stirring member, the sampling interval varies depending on the rotating velocity in the signal processing, thus calculating the inaccurate time as the final remaining amount of toner.

SUMMARY OF THE INVENTION

The present invention is devised in consideration of the above-mentioned points. An aspect of the present invention is to be able to detect an amount of remained developing-agent (i.e., toner) with high accuracy.

According to a first aspect of the present invention, an image forming apparatus is provided with a first operating mode and a second operating mode, where the image forming velocity of the second operating mode is different from that in the first operating mode. The image forming apparatus comprises: a developing-agent containing portion that contains a developing agent; an optical developing-agent amount detecting unit that detects the amount of developing agent in the developing agent containing portion; a processing unit configured to obtain the amount of developing agent based on data on the amount of developing agent detected by the developing-agent amount detecting unit; and a storing unit that stores information for correcting data on the amount of developing agent detected by the developing-agent amount detecting unit in the second operating mode, wherein the processing unit corrects the data on the amount of developing agent detected by the developing-agent amount detecting unit in the second operating mode based on the information stored in the storing means, and obtains the amount of developing agent based on the corrected data.

According to still another aspect of the present invention, there is provided a developing-agent amount detecting method of an image forming apparatus for forming an image in a first operating mode and an image in a second operating mode, where the image forming velocity in the second operating mode is different from that in the first operating mode. The image forming apparatus comprises: a developing-agent containing portion containing a developing agent; an optical developing-agent amount detecting unit configured to detect the amount of developing agent in the developing-agent containing portion; and a storing unit configured to store data on the amount of developing agent detected by the developing-agent amount detecting unit in the second operating mode. The developing-agent amount detecting method comprises: a correcting step of correcting the data on the amount of developing agent detected by the developing-agent amount detecting unit in the second operating mode based on the information stored in the storing unit; and a calculating step of obtaining the amount of developing agent based on the data corrected in the correcting step.

According to still yet another aspect of the present invention, a cartridge, detachably mountable to an image forming apparatus, is provided with a first operating mode and a second operating mode, where the image forming velocity of the second operating mode is different from that in the first operating mode. The image forming apparatus comprises: an optical developing-agent amount detecting unit configured to detect the amount of developing agent in a developing-agent containing portion for containing a developing agent. The cartridge comprises: the developing-agent containing portion; and a storage medium comprising a storage area which stores information for correcting the data on the amount of developing agent detected by the developing-agent amount detecting means in the second operating mode.

According to another aspect of the present invention, a cartridge, being detachably mountable to an image forming apparatus, is provided with a first operating mode and a second operating mode, where the image forming velocity of the second operating mode is different from that in the first operating mode. The image forming apparatus including an optical developing-agent amount detecting device configured to detect the amount of developing agent in a developer for containing a developing agent. The cartridge comprises: the developer unit; and a storage medium having a storage area configured to store information for correcting data detected by the developing-agent amount detecting device in the second operating mode.

According to another aspect of the present invention, a storage medium, mounted on a cartridge usable with a image forming apparatus, is provided with a first operating mode and a second operating mode, where the image forming velocity of the second operating mode is different from that in the first operating mode. The apparatus comprising an optical developing-agent amount detecting unit configured to detect the amount of developing agent in a developing-agent containing portion for containing a developing agent. The storage medium comprises: a storage area comprising a storage area for storing information for correcting data on the amount of developing agent detected by the developing-agent amount detecting unit in the second operating mode.

According to still yet another aspect of the present invention, a storage medium, mounted on a cartridge usable with an image forming apparatus is provided with a first operating mode and a second operating mode, where the image forming velocity of the second operating mode is different from that in the first operating mode. The image forming apparatus comprises an optical developing-agent amount detecting device configured to detect the amount of developing agent in a developer for containing a developing agent. The storage medium comprises: a storage area configured to store information for correcting data detected by the developing-agent amount detecting device in the second operating mode.

Further aspects, features and advantages of the present invention will become apparent from the following description of the exemplary embodiments with reference to the attached drawings.

DESCRIPTION OF THE EMBODIMENTS

Next, a description is given of a developing device, a processing cartridge, and an image forming apparatus using the processing cartridge according to an embodiment of the present invention.

[Entire Structure of Color Image Forming Apparatus]

Figure 1:
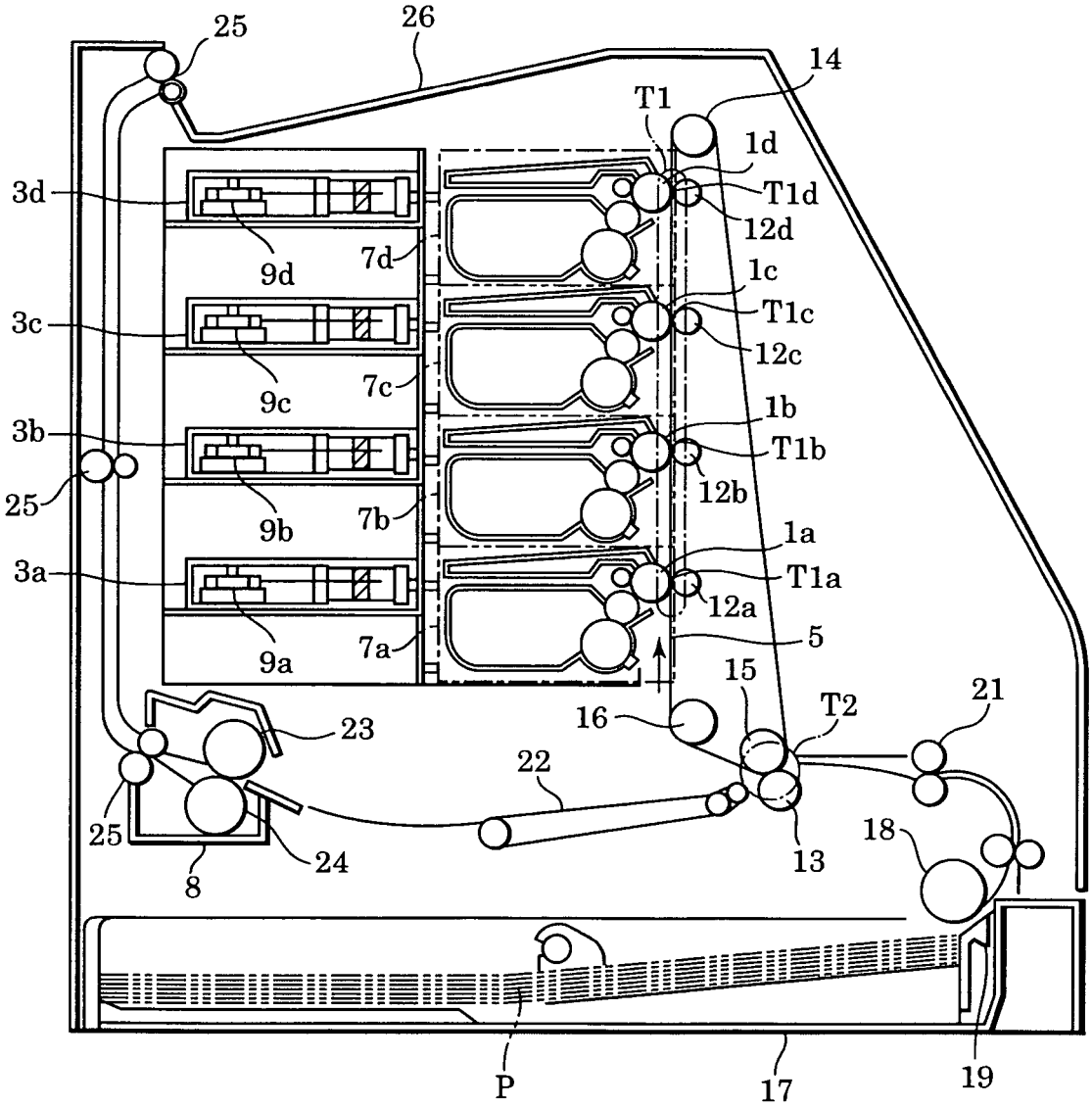
FIG. 1 is a cross-sectional view showing the entire structure of a full-color image forming apparatus according to an embodiment of the present invention.
Figure 2:
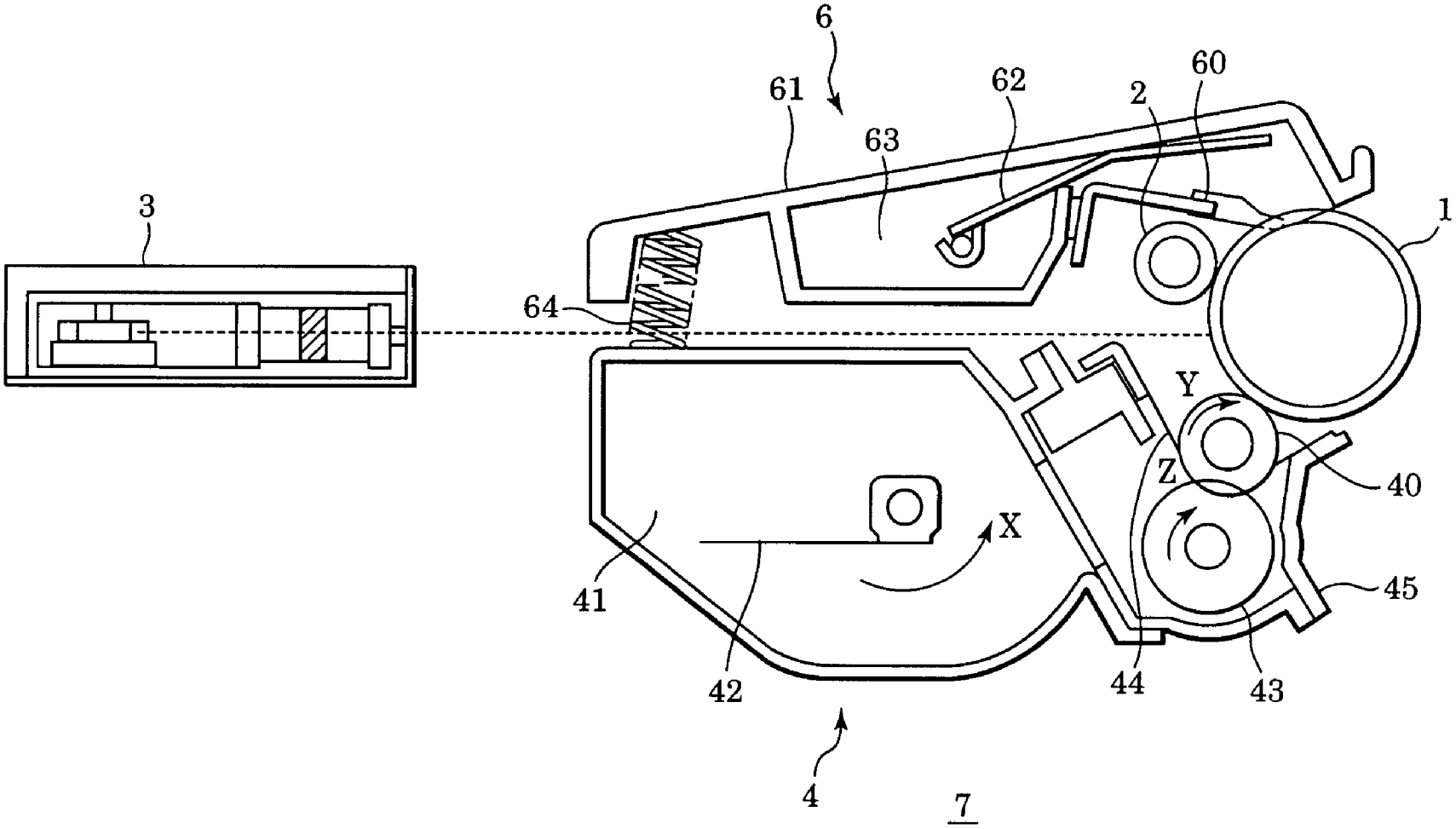
FIG. 2 is a cross-sectional view showing the entire structure of a processing cartridge according to an embodiment of the present invention.

First, a description of the entire structure of a color image forming apparatus with reference to FIGS. 1 and 2 is provided. FIG. 1 is a diagram showing the entire structure of a full-color laser printer as a color image forming apparatus according to the present embodiment of the present invention. FIG. 2 is a diagram showing the entire structure of the processing cartridge used for the image forming apparatus.

Referring to FIG. 1, the color laser printer comprises: an image forming portion having image carrying members for Y, M, C, and Bk; and an intermediate transfer member 5 which stores a color image that is developed by an image forming portion and is multi-transferred and which transfers the image to a transfer member P fed from a feed portion. A photosensitive drum 1 (1*a* to 1*d*), as the image carrying member, is rotated in the counterclockwise direction by a driving mechanism such as a motor (not shown).

Referring to FIG. 2, a process cartridge 7 (7*a* to 7*d* of FIG. 1) comprises, in the order of the rotating direction: a charging device 2 (2*a* to 2*d* in FIG. 1) which uniformly charges the surface of the photosensitive drum 1; a scanner unit 3 (3*a* to 3*d* in FIG. 1) which irradiates laser beams based on image information and which forms an electro-static images on the photosensitive drum 1; a developing device 4 (4*a* to 4*d* in FIG. 1) which adheres the toner to the electro-static image and develops the toner image; and a photosensitive unit 6 (6*a* to 6*d* in FIG. 1), including a cleaning device which transfers the toner image on the photosensitive drum 1 on the intermediate transfer device 5 by a first transfer portion T1 and removes the remaining transfer toner which remains on the surface of the photosensitive drum 1 after transfer.

Returning to FIG. 1, the toner image transferred to the intermediate transfer member 5 is further transferred to the transfer member P at a second transfer portion T2 by a secondary transfer roller 13. The transfer member P having the transferred color image is conveyed to a fixing portion 8. The color image is fixed to the transfer member P and discharge rollers 25 discharge the image to a discharge tray 26 on the apparatus.

The photosensitive unit including the photosensitive drum 1 and the cleaning device 6, the charging device 2, and the developing device 4 are integrally used as a cartridge, and forms a processing cartridge 7 (7*a* to 7*d*).

An image forming apparatus main body 100 has a closing cover (not shown) which integrally has the intermediate transfer member 5. The processing cartridge 7 detaches the photosensitive drum 1 from the front of the image forming apparatus main body 100 while the processing cartridge opens the closing cover.

Next, the detailed description is given of the structure of portions in the image forming apparatus.

[Photosensitive Drum]

The photosensitive drum 1 is formed by coating an organic photoconductive layer (OPC photosensitive member) on the outer circumferential surface of an aluminum cylinder with the diameter of 30 mm. The photosensitive drum 1 is rotatably supported by a supporting member (not shown) at both ends thereof. Driving force from a driving motor (not shown) is transmitted to one end, thereby driving the photosensitive drum 1 in the counterclockwise direction (shown in FIG. 2).

[Charging Device]

The charging device 2 is a contact-roller charging type one. The charging member is a conductive roller which is formed like a roller. The roller comes into contact with the surface of the photosensitive drum 1 and charging bias is applied to the roller, thereby uniformly charging the surface of the photosensitive drum 1.

[Exposing Device]

In the scanner unit 3, as an exposing device, the image signal is applied to a laser driver unit (not shown) comprising a laser driving circuit and a laser diode, where the laser diode irradiates image light corresponding to the image signal to a polygon mirror 9 (9*a* to 9*d* in FIG. 1) which is fast rotated by a scanner motor. The image light irradiated by the polygon mirror 9 selectively exposes, via an image forming lens, the surface of the photosensitive drum 1 which is rotated at constant velocity. Thus, the electro-static image is formed onto the photosensitive drum 1.

[Developing Device]

In order to visualize the electro-static image, the developing device 4 comprises a toner container 41 which contains toners of yellow, magenta, cyan, and black. The toners in the toner container 41 are fed to a toner feed roller 43 by a feed mechanism 42. The toners are coated by a developing blade 44 which is pressed and comes into contact with the outer circumferences of the toner feed roller 43. The developing roller 40 is rotated in the clockwise direction (shown in FIG. 2), and charges are applied to the toners.

Developing bias is applied to the developing roller 40 facing the photosensitive drum 1 having the electro-static image, thereby developing the toner onto the photosensitive drum 1 in accordance with the electro-static image.

[Intermediate Transfer Member]

The intermediate transfer member 5 is rotated in the clockwise direction (shown in FIG. 2) synchronously with the outer-circumferential velocity of the photosensitive drum 1 for multi-transferring the toner image on the photosensitive drum 1 that is visualized by the processing cartridge 7 in the operation of the image forming device 100. The toner image formed onto the photosensitive drum 1 is arranged at the facing position of the photosensitive drum 1, sandwiching the intermediate transfer member 5. Further, the toner image is multi-transferred onto the intermediate transfer member 5 by a primary transfer portion T1 (T1*a* to T1*d*) serving as the contact with a primary transfer roller 12 (12*a* to 12*d*) to which a voltage is applied. The intermediate transfer member 5 through the multi-transfer operation sandwiches and conveys the transfer member P by the secondary transfer roller 13 to which the voltage is applied at the secondary transfer portion T2, thereby simultaneously multi-transferring the toner images of colors on the intermediate transfer member 5 on the transfer member P.

The intermediate transfer member 5 (intermediate transfer belt) according to the present embodiment comprises a seamless resin belt with the circumferential length of approximately 620 mm, and is pulled by three shafts comprising the driving roller 14, a secondary transfer facing roller 15, and a tension roller 16, where both ends of the tension roller 16 are weighted by a spring. Thus, if the circumferential length of the intermediate transfer belt 5 changes due to the aging or the temperature and humidity of the main body, the amount of change is absorbed.

An adhesive adheres a guide rib (not shown) containing rubber throughout the entire circumference of one side end in the intermediate transfer member 5. One end of the tension roller 16 has a flange (not shown) having the inclination and contains resin, and the guide rib and the flange regulate the direction perpendicular to the transmitting direction of the intermediate transfer member 5 (hereinafter, referred to as "inclination")

The intermediate transfer member 5 is connected to the main body with the driving roller 14 as a supporting point. Driving force of the driving motor (not shown) is transmitted to one end (shown in FIG. 2) of the driving roller 14 on the back, thereby rotating the intermediate transfer member 5 in the clockwise direction in accordance with the image forming operation.

[Sheet Feed Portion]

A sheet feed portion feeds the transfer members P to the image forming portion. It is comprised mainly of a cassette 17, which accommodates therein a plurality of transfer members P, a sheet feed roller 18, a separating pad 19, a sheet feed guide 20, and a pair of resist rollers 21. When forming an image, the sheet roller 18 is rotated in accordance with the image forming operation, and the transfer members P in the cassette 17 are separated and then fed out one by one. The sheet feed guide 20 guide the transfer members P, and the transfer members P reach the pair of resist rollers 21 via the conveying roller (not shown).

During formation of an image, the pair of resist roller 21 performs the non-rotating operation in which the transfer members P stop and are waited and the rotating operation in which the transfer members P are conveyed to the intermediate transfer member 5 in accordance with predetermined sequence. This positions the image in the transfer processing, which is the next processing performed on the transfer members P.

[Transfer Portion]

The transfer portion comprises a secondary transfer roller 13, which can be oscillated. The secondary transfer roller 13 has a metallic shaft which is wound by a middle-resistant foaming elastic member, and is driven movably in the vertical direction (not shown). The transfer roller 13 is pressed to the intermediate transfer member 5 by a predetermined pressure at the up position, namely, via the transfer member P by a cam member (not shown) at the timing for transferring the color image onto the transfer member P.

The bias is simultaneously applied to the transfer roller 13, and the toner image on the intermediate transfer member 5 is transferred to the transfer member P. Since the intermediate transfer member 5 and the secondary transfer roller 13 are driven, the transfer member P sandwiched therebetween is subjected to the transfer processing and is simultaneously conveyed at predetermined velocity in the left direction (shown in FIG. 2). Further, a conveying belt 22 conveys the transfer member P to a fixing portion 8 serving as the next processing.

[Fixer]

The fixing portion 8 fixes the toner image formed onto the transfer member P by the developing means via the intermediate transfer member 5. In addition, it comprises a film guide unit 23, including a ceramic heater for applying the heat to the transfer member P, and a pressurizing roller 24 for pressing the transfer member P in contact with the film guide unit. That is, the transfer member P holding the toner image is conveyed by the film guide unit 23 and the pressurizing roller 24, and the toner is fixed onto the transfer member P by applying the heat and pressure.

[Image Forming Operation]

Next, a description is given of the operation for forming an image by the above-structured device.

First, the sheet feed roller 18 shown in FIG. 1 is rotated and one of the transfer members P in the sheet feed cassette 17 is separated. Then, the separated transfer member P is conveyed to the resist roller 21.

The photosensitive drum 1 and the intermediate transfer member 5 are rotated, in the direction shown by the arrow depicted in FIG. 1 at a predetermined outer-circumferential velocity V (hereinafter, referred to as processing velocity).

The photosensitive drum 1, which is uniformly charged by the charging device 2 on the surface thereof, is subjected to the laser exposure, and forms the image.

1. Formation of Yellow Image

The scanner portion 3*a* irradiates the laser beams of the yellow image, thereby forming the yellow image onto the photosensitive drum 1*a*. The yellow developing device 4*a* is driven simultaneously with the electro-static image formation, and a voltage with the same potential having the same polarity as those of the photosensitive drum 1*a* is applied so as to adhere the yellow toner to the electro-static image of the photosensitive drum 1*a*, thereby developing the yellow image. Simultaneously, at the first transfer position T1*a* on the downstream of the developing portion, the yellow toner image on the photosensitive drum 1*a* is primarily transferred to the outer circumference of the intermediate transfer member 5. In this case, a voltage with the inverse property of the yellow toner is applied to the intermediate transfer member 5, thereby performing the primary transfer operation.

2. Formation of Magenta Image

Next, the scanner portion 3*b* starts the laser irradiation of the magenta image so that the edges of the magenta image and the yellow image match each other at the outer circumference of the intermediate transfer member 5. Similarly to the yellow image, the magenta toner image is developed to the electro-static image on the photosensitive drum 1*b*. The magenta toner image on the photosensitive drum 1*b* is overlaid and is transferred onto the yellow toner image on the intermediate transfer member 5 at the first transfer position T1*b*.

3. Formation of Cyan Image

Next, the scanner portion 3*c* starts the laser irradiation of the cyan image so that the edges of the yellow image, the magenta image, and the cyan image match each other at the outer circumference of the intermediate transfer member 5. Similarly to the magenta image, the cyan toner image is developed to the electro-static image on the photosensitive drum 1*c*. The cyan toner image on the photosensitive drum 1*c* is overlaid and is transferred onto the yellow toner image and the magenta toner image on the intermediate transfer member 5 at the first transfer position T1*c*.

4. Formation of Black Toner Image

Next, the scanner portion 3*d* starts the laser irradiation of the black image so that the edges of the yellow image, the magenta image, the cyan image and the black image match each other at the outer circumference of the intermediate transfer member 5. Similarly to the cyan image, the black toner image is developed to the electro-static image on the photosensitive drum 1*d*. The black toner image on the photosensitive drum 1*d* is overlaid and is transferred onto the yellow toner image, the magenta toner image, and the cyan toner image on the intermediate transfer member 5 at the first transfer position T1*d*.

In the sequence of yellow, magenta, cyan, and black, the electro-static formation, development, and toner transfer to the intermediate transfer member 5 are performed at the first transfer positions T1*a*, T1*b*, T1*c*, and T1*d*. A full-color image containing the four toners of yellow, magenta, cyan, and black is formed onto the surface of the intermediate transfer member 5.

Before the primary transfer of the fourth black-toner ends and then the edge of the image on the intermediate transfer member 5 having the full-color image arrives at the second transfer portion T2, the transfer member P waited by the resist rollers 21 starts to be conveyed at the matching timing. The secondary transfer roller 13 is waited at the down position in the image formation of four colors on the intermediate transfer member 5, and is in the non-contact state with the intermediate transfer member 5. The secondary transfer roller 13 is moved up by a cam (not shown), thereby pressing the transfer member P in contact with the second transfer portion T2. Further, the bias with the opposite polarity of the toner is applied to the secondary transfer roller 13, thereby simultaneously transferring the full-color image of four colors on the intermediate transfer member 5 onto the transfer member P. The transfer member P through the second transfer portion T2 is pealed from the intermediate transfer member 5, and is conveyed to the fixing portion 8. The toner is fixed to the transfer member 5 and thereafter is discharged onto a discharge tray 26 at the top position of the main body via the discharge rollers 25 while the image surface is in the down direction. Then the image forming operation ends.

The transfer member P used for the image forming device 100 includes a normal sheet, a thick sheet, a gross sheet, and OHT. In the case of using the transfer member P except for the normal sheet, the toner fixing property changes at the fixing portion 8. Therefore, it is necessary to fix the transfer member P at sheet conveying velocity (processing velocity) corresponding to the transfer member. According to the present embodiment, in the case of the thick sheet or gross sheet, the printing mode is ½ (½ velocity mode) of the normal velocity (normal velocity mode) for image formation of the normal sheet. In the case of OHT, the printing mode is ⅓ (⅓ velocity mode) of the normal velocity. The user determines the transfer member used in the printing command, thereby determining these printing modes. According to the present embodiment, a transfer-member determining sensor (not shown) automatically determines the transfer member, and automatically selects the best printing mode.

[Structure of Processing Cartridge]

Figure 3:
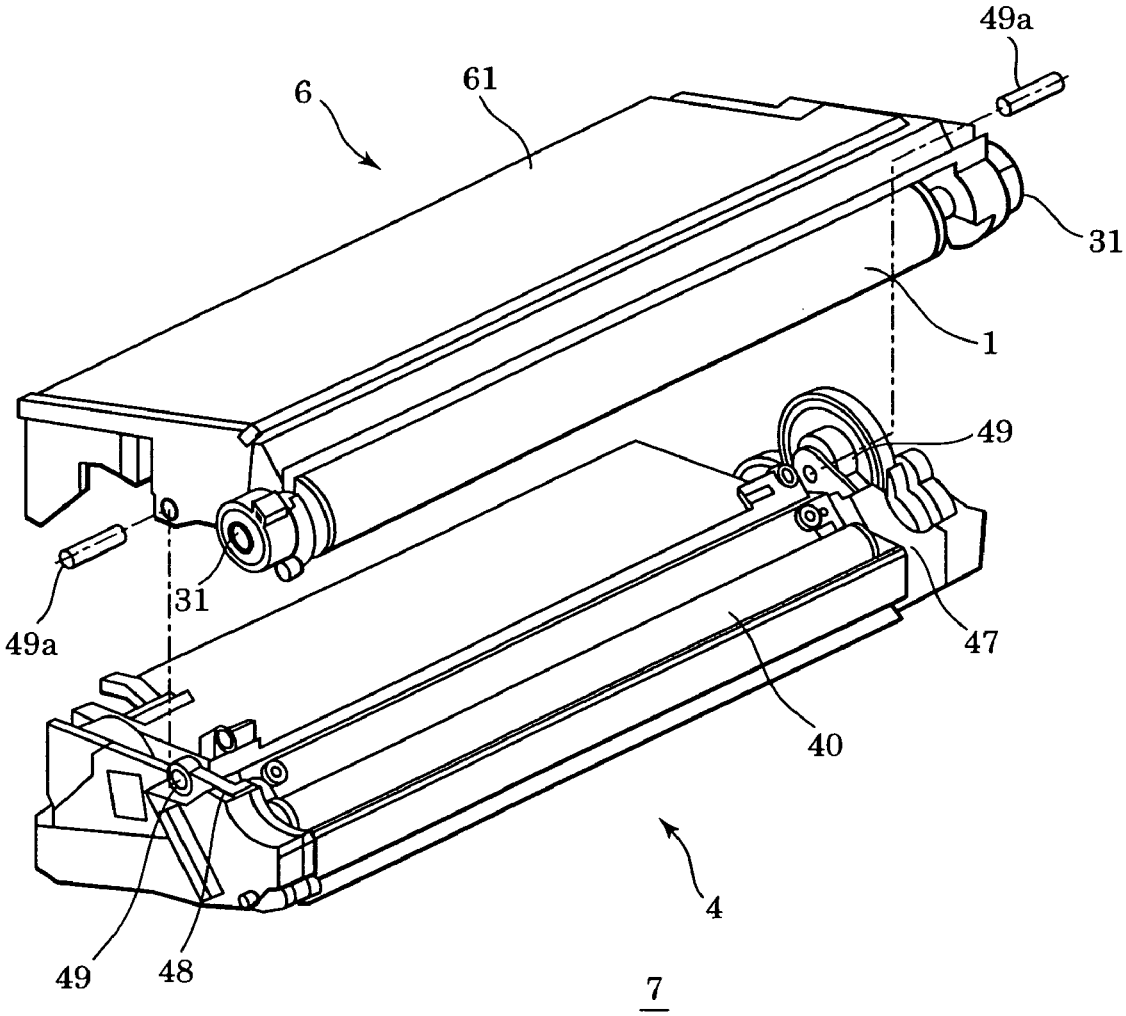
FIG. 3 is a perspective view showing the processing cartridge according to an embodiment of the present invention.

Next, a detailed description is given of the processing cartridge according to the present embodiment with reference to FIGS. 2 and 3. FIGS. 2 and 3 are a main cross-sectional view and a perspective view of the processing cartridge 7, which accommodates therein the toners. The processing cartridges 7*a* to 7*d* of yellow, magenta, cyan, and black have the same structure.

Referring to FIG. 3, the processing cartridge 7 comprises: the photosensitive drum 1 as a drum electrophotography photosensitive member serving as the image carrying member; the photosensitive drum unit 6 having the charging device 2 and a cleaning blade 60; and the developing unit 4 having a developing roller 40 for developing the electro-static image on the photosensitive drum 1.

In the photosensitive drum unit 6, the photosensitive drum 1 is rotatably attached to a cleaning frame 61 via a shaft supporting member 31. The photosensitive drum 1 comprises, on the circumference thereof, the charging device 2 for uniformly charging the surface of the photosensitive drum 1, and the cleaning blade 60 for removing the toner remaining on the photosensitive drum 1. A power source (not shown) in the image forming apparatus 100 main body applies charging bias to the charging device 2 via a charging contact (not shown).

The remaining toner removed from the surface of the photosensitive drum 1 by the cleaning blade 60 is sequentially sent to a removed toner room 63 arranged on the back of the cleaning frame 61 by a toner feed mechanism 62. By transmitting driving force of a driving motor (not shown) to one end, the photosensitive drum 1 is rotated in the counterclockwise direction in accordance with the image formation.

The developing unit 4 comprises the developing roller 40 which comes into contact with the photosensitive drum 1 and is rotated in the direction shown by an arrow Y, the toner container 41 which contains the toner, and the developing container 45. The developing roller 40 is rotatably supported to the developing container 45 via developing shaft supporters 47 and 48. The developing roller 40 comprises, on the circumference thereof, a toner feed roller 43 which comes into contact with the developing roller 40 and is rotated in the direction shown by an arrow Z, and a developing blade 44. Further, the toner container 41 has the toner conveying mechanism 42 which stirs the contained toner and conveys the toner to the toner feed roller 43.

Referring to FIG. 3, the developing unit 4 has a suspension structure, in which a connecting pin 49*a* supports the entire developing unit 4 with supporting holes 49 as center arranged to the developing shaft supports 47 and 48 attached to both ends of the developing unit 4, slidably to the photosensitive drum unit 6.

In the case of the single processing cartridge 7 (which is not attached to the printer main body), a pressurizing spring 64 always energizes the developing unit 4. Thus, the rotating moment enables the developing roller 40 to come into contact with the photosensitive drum 1 with the connecting pin 49*a* as center.

The toner contained by the toner stirring member 42 is conveyed to the toner supply roller 43. Then, the toner feed roller 43, which is rotated in the direction shown by the arrow Z, feeds the toner to the developing roller 40 by the friction created with the developing roller 40, which is rotated in the direction shown by the arrow Y. Then, the toner is carried onto the developing roller 40. The toner carried onto the developing roller 40 reaches the developing blade 44 in accordance with the rotation of the developing roller 40. Then, the developing blade 44 applies charges to the toner and forms a predetermined toner thin layer.

The toner is conveyed to the developing portion, where the photosensitive drum 1 meets the developing roller 40. DC developing bias applied to the developing roller 40, the toner feed roller 43, and the developing blade 44 via developing contacts (not shown) from a power supply (not shown) in the image forming apparatus 100 main body adheres the toner to the electro-static image formed onto the surface of the photosensitive drum 1 at the developing portion, and the electro-static image is developed.

The remaining toner on the surface of the developing roller 40 which does not contribute to the development is returned in the developer in accordance with the rotation of the developing roller 40. Then, the remaining toner is pealed and is collected from the developing roller 40 at a friction portion with the toner feed roller 43. The collected toner is stirred and mixed to the remaining toner by the toner stirring mechanism 42.

In the contact developing method by which the photosensitive drum 1 comes into contact with the developing roller 40 for development, the photosensitive drum 1 is rigid and the developing roller 40 using the photosensitive drum 1 is a roller having an elastic member. As the elastic member, a solid rubber layer is coated with resin in view of the charging applying operation to the solid rubber single-layer or toner.

The toner feed roller 43 is an elastic roller having a core portion and a sponge portion. The sponge portion contains foaming sponge.

[Structure of Stirring Member and Light-transmission-type Detection of Remaining Amount of Toner]

Figure 4:
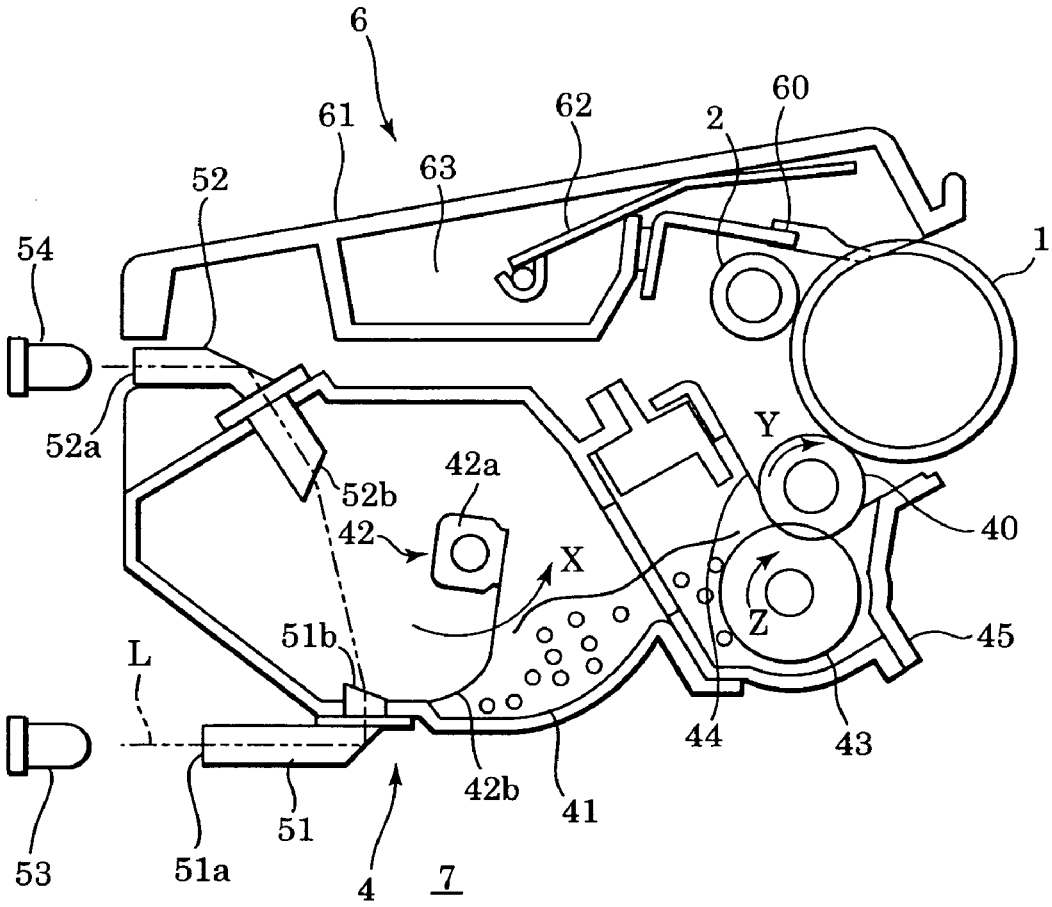
FIG. 4 is a cross-sectional view showing the processing cartridge having the structure for detecting a light-transmission-type toner remaining-amount according to an embodiment of the present invention.
Figure 5:
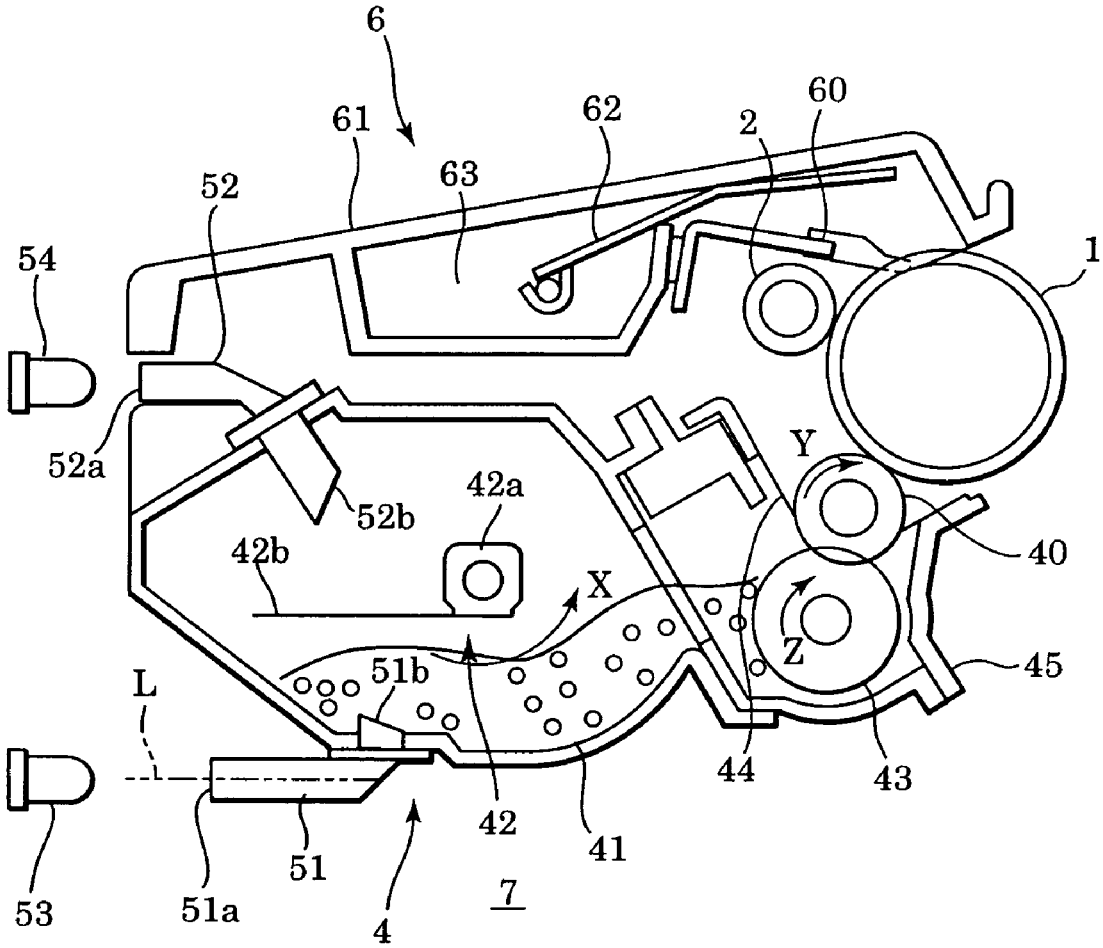
FIG. 5 is a cross-sectional view showing the processing cartridge having the structure for detecting the light-transmission-type toner remaining-amount according to an embodiment of the present invention.

Next, a description is given of the structure of the stirring member and the light-transmission-type detection of the remaining amount of toner with reference to FIGS. 4 and 5. FIGS. 4 and 5 are cross-sectional views showing a toner remaining-amount detecting portion of the processing cartridge.

Referring to FIG. 4, the toner container 41 for containing the toner comprises the toner stirring member 42 which is rotated in the X direction, thereby conveying the toner to the toner feed roller 43. The stirring member 42 mainly comprises a shaft member 42*a* which is molded by resin and a PET sheet 42*b* serving as a flexible sheet member for stirring the toner.

A driving gear (not shown) is pierced and is inserted in the toner container 41 on the side surface thereof, and transmits the driving force to the stirring member 42.

The toner container 41 has an incident light guide 51 integrally having a light transmitting window for detecting the remaining amount of toner and a light introducing portion and an output light guide 52 on bottom and top surfaces, respectively. The incident light guide 51 guides, to the toner container 41, light L for detecting the remaining amount of toner which is emitted from an LED 53 serving as a light emitting portion arranged to the image forming apparatus 100 main body. The detected light L, which passes through the toner container 41, is guided to a phototransistor 54 serving as a light receiving portion arranged to the image forming apparatus 100 main body via the output light guide 52. A sheet member 42*b* of the stirring member 42 shields the detected light L in accordance with the rotation, and cleans a toner container light-transmitting surface Sib of the incident light guide 51 and a toner container light-transmitting surface 52*b* of the output light guide.

Referring to FIG. 4, the sheet member 42*b* has just cleaned the toner container light-transmitting surface Sib of the incident light guide 51. The detected light L is transmitted through the toner container 41 because the remaining amount of toner is relatively low. Further, the detected light L is detected by the light receiving portion in the image forming apparatus 100 main body via the output light guide 52.

Referring to FIG. 5, just before the sheet member 42*b* cleans the toner container light-transmitting surface Sib of the incident light guide 51, the detected light L is shielded by the toner container 41 due to the existence of the toner and the stirring member 42. The detected light L does not reach the output light guide 52 and is not detected by the light receiving portion 54 in the image forming apparatus 100 main body.

The output waveform upon receiving the detected light L by the phototransistor 54 is sampled at a predetermined sampling interval. Then, the output waveform is binarized by a predetermined threshold. The pulse width at the low level is counted and is outputted as information on the pulse width corresponding to the light receiving time.

Figure 6:
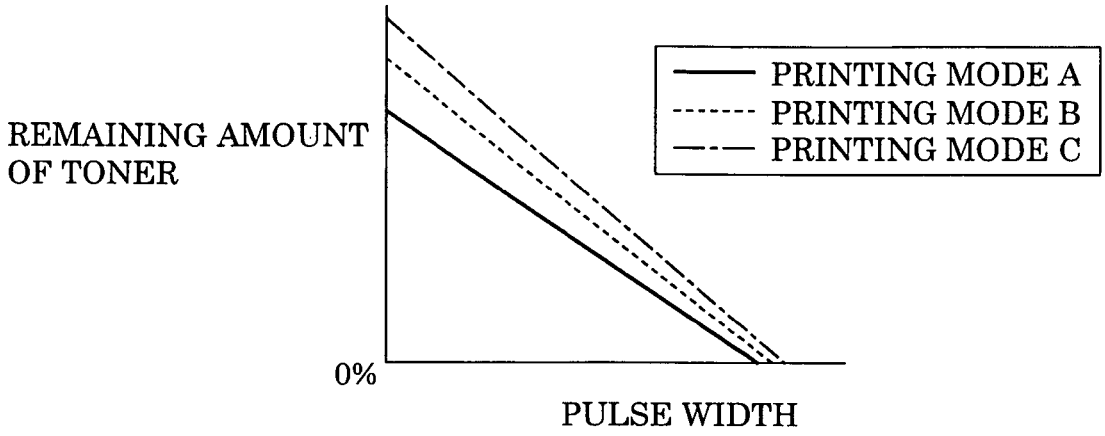
FIG. 6 is a graph showing a relationship between the remaining amount of toner and a pulse width according to an embodiment of the present invention.

With the above-mentioned structure, referring to FIG. 6, a relationship is shown between the toner in the toner container 41 and the pulse width corresponding to the light receiving time of the detected light L which is transmitted through the toner container 41 every rotation of the stirring member 42 and which is received by the phototransistor 54 in the image forming apparatus 100. According to the present embodiment, the relationship between the pulse width and the remaining amount of toner is expressed by a linear functional formula, and the remaining amount of toner is obtained based on the pulse width corresponding to the light receiving time of the detected light L.

Specifically, the light received by the phototransistor 54 per rotation of the stirring member 42 is sampled by predetermined number of times. The light receiving time obtained by sampling by the predetermined number of times is detected as the light receiving time per rotation. For example, when the rotation of the stirring member is one per sec and then the sampling period is 0.01 sec, the detected-light receiving time is 0.5 sec. In this case, a detecting value of 50 pulses is detected as data.

The printing mode A in FIG. 6 shows a relationship between the pulse width and the remaining amount of toner in the normal velocity mode. As mentioned above, the image forming apparatus 100 changes the sheet conveying velocity (processing velocity) depending on the type of transfer member P as mentioned above. In this case, the driving velocity of the photosensitive drum serving as a member forming the processing cartridge 7 needs to be changed. Thus, the rotating velocity of the stirring member 42 is changed and thus is ½ or ⅓ of the normal velocity mode. In this case, since the number of sampling times is set to be equal and the pulse width is equivalent, the predetermined sampling interval (sampling time interval) is set to twice in the case of ½ velocity and is set to three times in the case of ⅓ velocity. However, the rotating velocity of the stirring member 42 is changed and then the toner floating state in the toner container 41 is changed. Thus, the sampling interval is changed but the pulse width is not equal. Further, the relationship between the pulse width and the remaining amount of toner is changed.

The relationship between the pulse width and the remaining amount of toner in the actual ½ velocity mode and ⅓ velocity mode is the printing mode B and the printing mode C in FIG. 6. When the velocity mode switches over, the pulse width to the same remaining amount of toner becomes the tendency which becomes large.

[Structure of a Storing Unit of Processing Cartridge]

Figure 7:
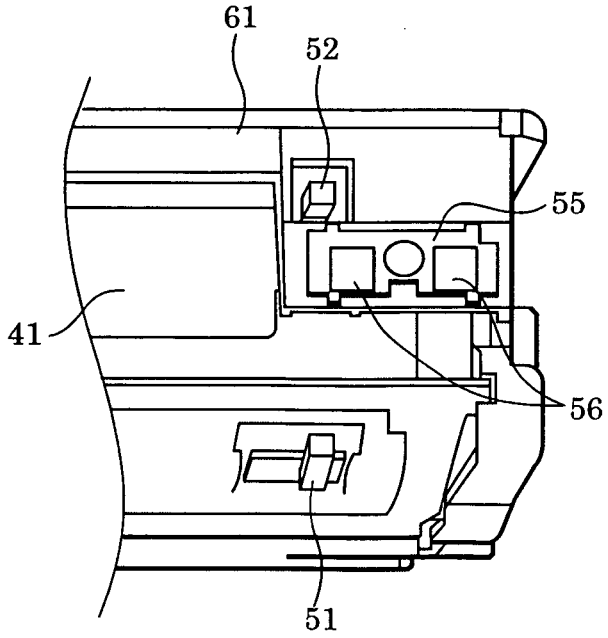
FIG. 7 is a perspective view showing storing means arranged to the processing cartridge according to an embodiment of the present invention.

Next, a description is given of the structure of a storing unit arranged to the processing cartridge 7 and the communication with the image forming apparatus 100 with reference to FIG. 7. A storing unit 55 (hereinafter, referred to as a memory unit 55) is arranged to the outer circumferential surface of the processing cartridge 7. The image forming apparatus 100 comprises a communication unit (not shown) serving as communication means connected to a controller (not shown). The processing cartridge 7 is attached to the image forming apparatus 100 main body and then a communication contact 56 on the memory unit 55 side comes into contact with a communication contact of the communication unit (not shown) on the image forming apparatus 100 main body side. Thus, a storing device of the memory unit 55 can be communicated with the controller, thereby reading and writing information of the storing device.

The memory unit 55 is attached to the processing cartridge 7 by a both-side tape, an adhesive, a thermal caulking tool, an ultrasonic adhesion, and snap fitting. The processing cartridge 7 is positioned to the image forming apparatus 100 by a positioning member arranged to the photosensitive drum unit 6. Thus, memory unit 55 is attached to the photosensitive drum unit 6 of the processing cartridge 7, thereby accurately being positioned to the communication unit of the image forming apparatus 100.

The memory unit 55 has coefficient (inclination) information of the linear functional formula indicating the relationship between the remaining amount of toner and the pulse width corresponding to the light receiving time of the detected light L and intercept information of the linear functional formula, as information for calculating the remaining amount of toner. The processing cartridge 7 is attached to the image forming apparatus 100 and then the coefficient (inclination) information and the intercept information are read to the control portion (not shown) of the image forming apparatus 100. The remaining amount of toner is calculated by the coefficient (inclination) information and the intercept information based on the pulse width corresponding to the light receiving time of the detected light L.

Next, a detailed description is given of the toner remaining-amount detecting device, the image forming apparatus, and the memory unit of the processing cartridge according to the present invention with reference to FIGS. 8 to 12.

Figure 8:
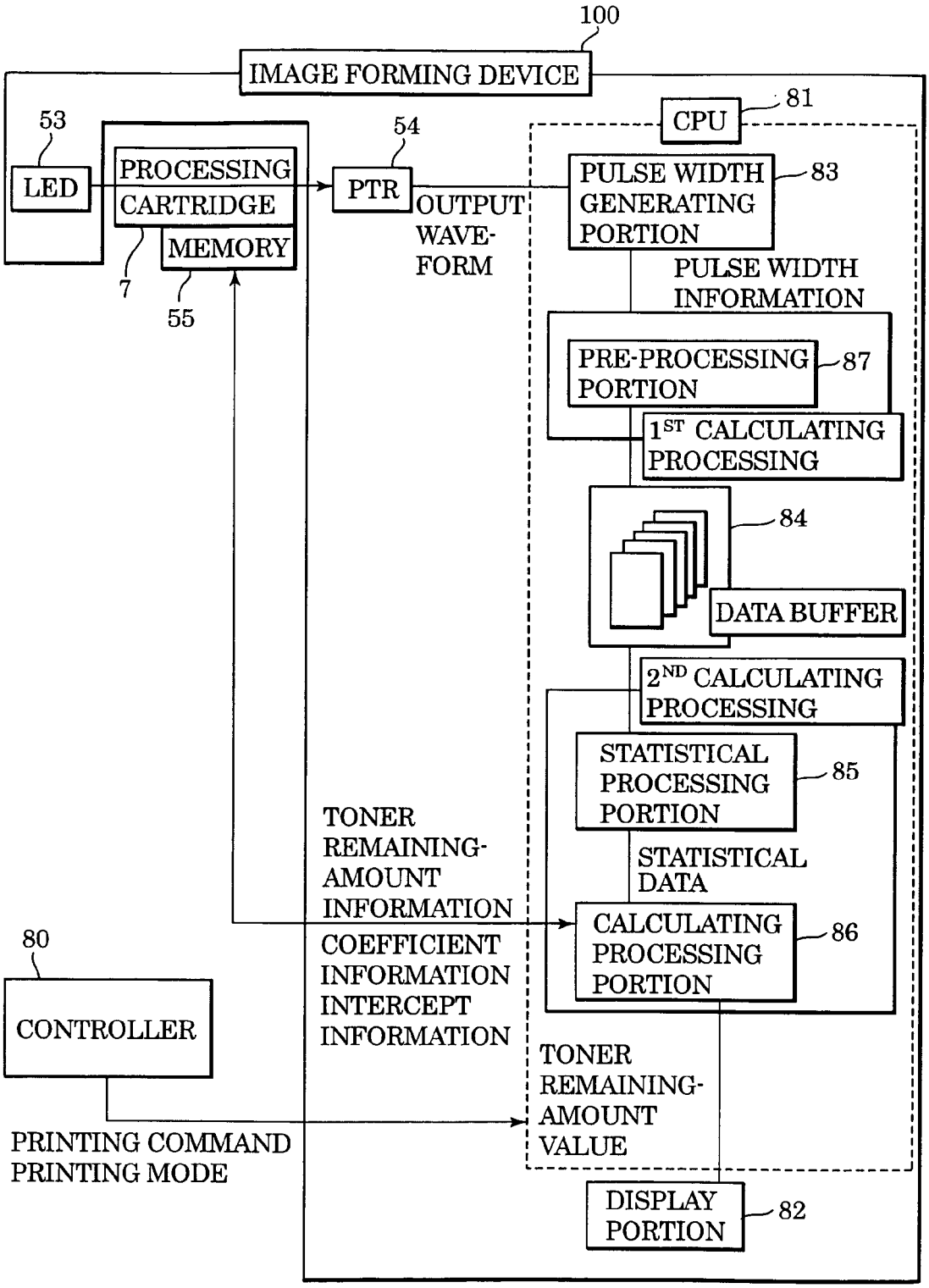
FIG. 8 is a block diagram showing the functional structure of the image forming apparatus according to an embodiment of the present invention.
Figure 9:
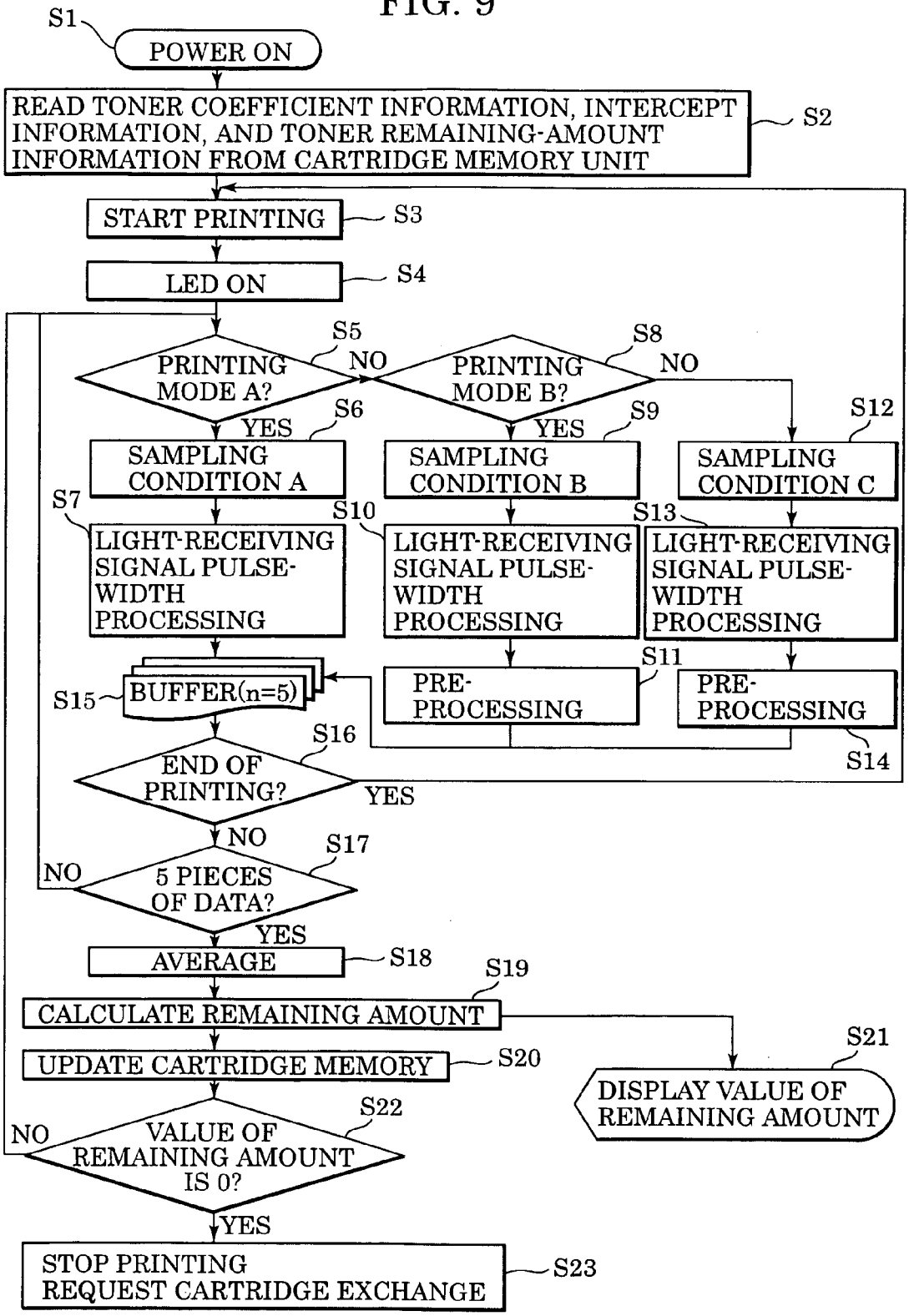
FIG. 9 is a flowchart showing the operation of a CPU according to an embodiment of the present invention.

FIG. 8 is a block diagram showing the functional structure of the image forming apparatus according to the present invention. FIG. 9 is a flowchart showing the operation of a CPU according to the present invention. Hereinbelow, the flow will be described with reference to FIGS. 8 and 9.

In step S1, the power supply of the image forming apparatus 100 is turned on. Alternatively, the power supply has been already been turned on and then the processing cartridge 7 is attached to the image forming apparatus 100. In step S2, information, including the information for calculating the coefficients for detecting the remaining amount of toner, in the memory unit 55 arranged to the processing cartridge 7 is read to a CPU 81 in the image forming apparatus 100.

In step S3, the printing command is sent from a controller 80 together with the information on the printing mode and then the printing operation starts. In step S4, the LED 53 emits light so as to detect the remaining amount of toner. In steps S5 and S8, the printing mode is selected. Then, a sampling condition (sampling interval) for outputting the detection of the remaining amount of toner from the LED 53 is determined depending on the selected printing mode in steps S6, S9, and S12. The sampling condition (sampling interval) is determined depending on the rotating velocity of the stirring member 42 which changes depending on the printing mode, namely, the printing velocity (processing velocity). The time per rotation of the stirring member 42 is determined depending on the printing velocity. The sampling condition (sampling interval) is determined depending on the printing velocity.

According to the present embodiment, the normal velocity mode (printing mode A) in the case of forming the image on the normal sheet is defined as a basic printing mode. In the printing mode A, namely, normal velocity mode, the detected light L emitted by the LED 53 is transmitted through the toner container 41 of the processing cartridge 7 and is received by the phototransistor 54. Then, the output waveform corresponding to the number of sampling times is converted into the pulse width by a pulse width generating portion 83 in step S7. Then, the pulse width is stored in a data buffer 84 for statistical processing of the obtained data on the pulse width in step S15.

In the printing mode B or C (in step S5 or S8), according to the present embodiment, the sampling condition is determined depending on the printing mode in steps S9 and S12. The output waveform of the phototransistor 54 is converted into the data on the pulse width by the pulse width generating portion 83 in steps S10 and S13. Then, the data on the pulse width is sent to a pre-processing portion 87, and the data on the pulse width is subjected to first calculating processing, serving as pre-processing, for converting the data on the pulse width into the data on the pulse width in the normal velocity mode in steps S11 and S14.

Figure 10:
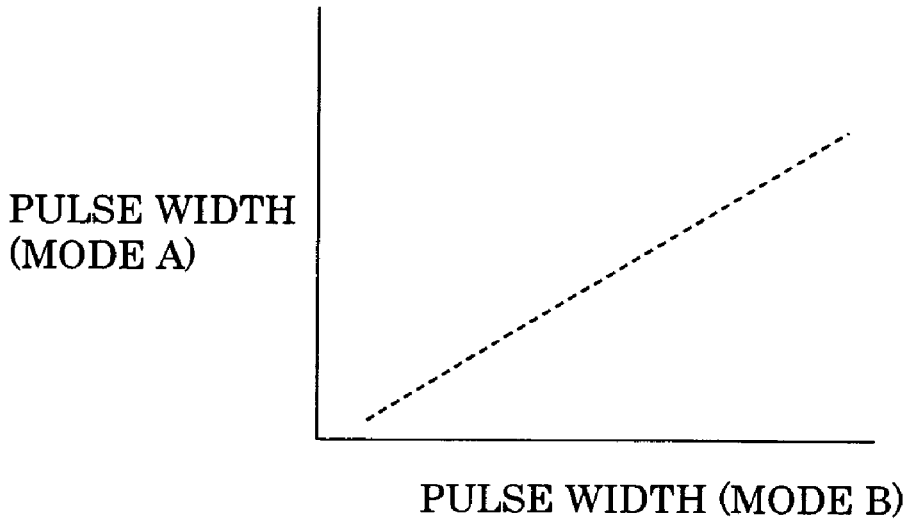
FIG. 10 is a graph showing a relationship of first calculating processing in a printing mode B according to an embodiment of the present invention.
Figure 11:
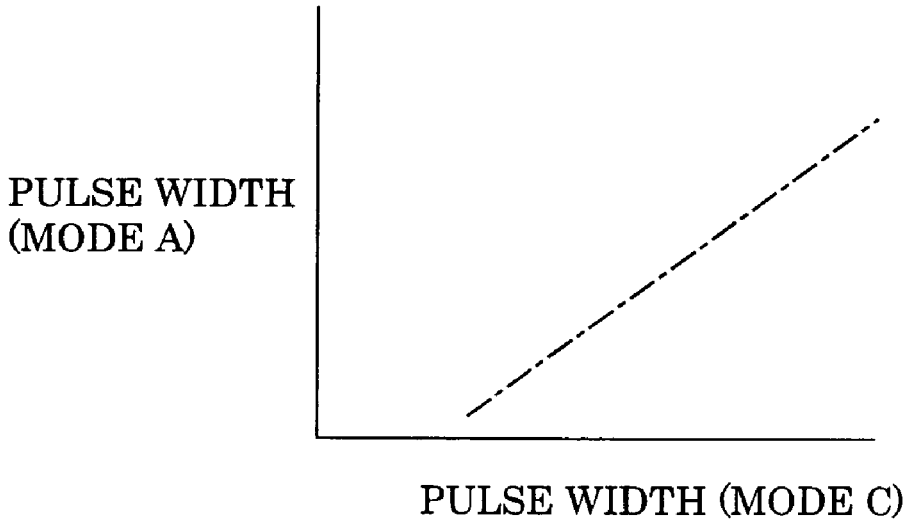
FIG. 11 is a graph showing a relationship of the first calculating processing in a printing mode C according to an embodiment of the present invention.

According to the present embodiment, the relationship between the pulse width and the remaining amount of toner is linear in the printing mode. Thus, the relationship between the normal velocity mode (printing mode A) and ½ velocity mode (printing mode B) and the relationship between the normal velocity mode (printing mode A) and ⅓ velocity mode (printing mode C) are shown in FIGS. 10 and 11, respectively. Based on the relationships (linear functional formula), the data is converted into one for using second calculating processing for calculating the remaining amount of toner based on the pulse width in the printing mode A. As shown in FIGS. 10 and 11, the data conversion is the change processing as the pulse width becomes small.

The memory in the processing cartridge 7 stores the linear functional formula as information indicating the relationship between the normal velocity mode (printing mode A) and ½ velocity mode (printing mode B) and the relationship between the normal velocity mode (printing mode A) and ⅓ velocity mode (printing mode C). The linear functional formula are read and used for correcting (converting) the data. The pre-processing data on the pulse width is stored in the data buffer 84, similarly to the case in the printing mode A.

Returning to FIG. 9, the printing operation ends in step S16 and then the processing returns to step S3. The printing mode is selected again by the printing command and the data is collected in the selected printing mode. If the printing operation continues, the data is repeatedly collected until five pieces of data are stored in the data buffer 84 (processing for storing the data on the pulse width corresponding to the five times of stirring operations). In step S17, if the five pieces of data on the pulse width are collected, then the process flows to step S18. If less than five pieces of data have been collected, flow returns to step S5.

In step S18, as processing for suppressing the variation in data and for precisely detecting the detection of the remaining amount of toner, a statistical processing portion 85 averages the data. Next, in step S19, a calculating processing portion 86 calculates a value of the remaining amount of toner by the averaged data on the pulse width and the relational formula (linear functional formula) between the pulse width and the remaining amount of toner in the normal velocity mode shown in FIG. 6. The value of the remaining amount of toner is sent and is displayed on a display portion 82 in step S21. Further, the value of the remaining amount of toner is sent to the memory unit 55 in the processing cartridge 7 and the information is updated in step S20.

In step S22, it is determined whether the value of the remaining amount of toner reaches 0. If the value has not reached 0, flow proceeds to step S5 and the printing operation and the detection of the remaining amount of toner continue. If the value reaches 0, flow proceeds to step S23, where the printing operation stops and the user is notified of a request for exchanging the processing cartridge.

The following control operation is executed by a processing portion (processing circuit) arranged in the CPU or a program (not shown) stored in a ROM. A description is given of functions of processing units in FIG. 8 with reference to the flowchart shown in FIG. 9. The pulse generating portion 83 executes processing in steps S6, S7, S9, S10, S12, and S13 in FIG. 9, and the pre-processing portion 87 executes processing in steps S11 and S14 in FIG. 9. The statistical processing portion 85 executes processing in step S18 in FIG. 9. The calculating processing portion 86 executes processing in step S19 in FIG. 9. Other steps are controlled by a central control portion (not shown) in the CPU based on the program stored in the ROM.

As a result of the above-mentioned processing, a plurality of printing modes are frequently changed. If the plurality of printing modes mixedly have the signal data for detecting the remaining amount of toner in the printing mode, the first calculating processing for converting the data on the pulse width in the printing mode, except for the normal velocity mode, into the data pulse width in the normal velocity mode converts the signal data for detecting the remaining amount of toner.

Then, the second calculating processing for calculating the remaining amount of toner from the pulse width of the basic printing mode (normal velocity mode) by using the corrected data obtains the remaining amount of toner. Thus, after the conversion to the processing data, the converted data is stored in the data buffer 84. The second calculating processing does not mixedly have improper data and the calculation and detection of the remaining amount of toner are properly performed. Therefore, the precision is improved.

According to the present embodiment, the coefficient information on the linear functional formula shown in FIGS. 10 and 11, namely, the information on the coefficient information used by the pre-processing portion 87 and the calculating processing portion 86 is stored in the memory unit 55 arranged to the processing cartridge 7.

Figure 12:
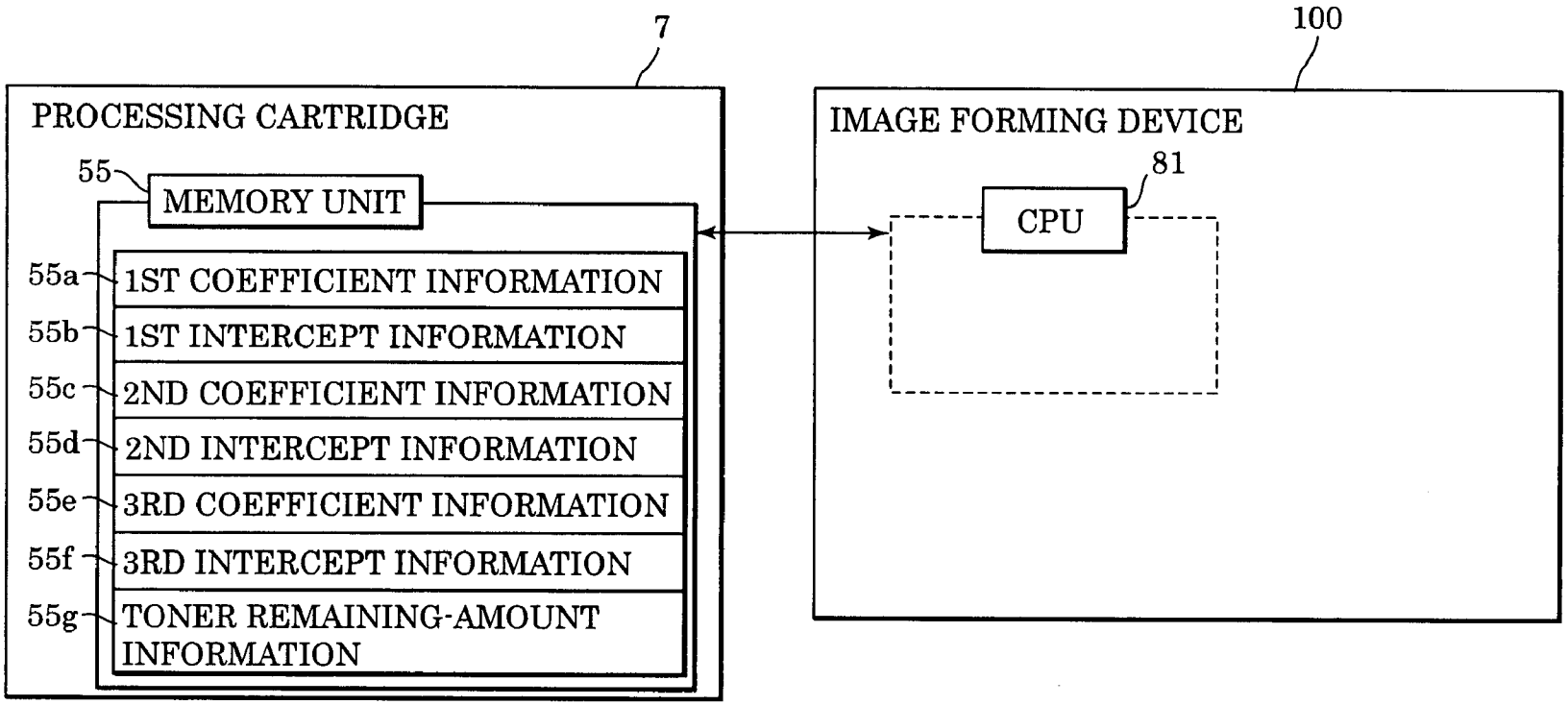
FIG. 12 is an address map showing contents of a memory unit according to an embodiment of the present invention.

FIG. 12 shows an address map showing the contents of the memory unit 55. As the coefficient information used by the calculating processing portion 86, first coefficient information is stored in a storage area at an address 55*a*. First intercept information is stored in a storage area at an address 55*b*. As two pair of coefficient information used by the pre-processing portion, second coefficient information corresponding to ½ velocity mode (printing mode B) is stored in a storage area at an address S5*c*, and second intercept information is stored in a storage area at an address 55*d*. Third coefficient information corresponding to ⅓ velocity mode (printing mode C) is stored in a storage area at an address 55*e* and third intercept information is stored in a storage area at an address 55*f*. In step S2 in FIG. 9, the coefficient information and the intercept information are read from the memory unit 55 to the CPU 81 in the image forming apparatus 100, thereby performing the calculating processing.

The information on the remaining amount of toner, which is calculated by the CPU 81, is updated and stored in a storage area at an address 55*g* in the memory unit 55.

A formula ($Y=-aX+d$) corresponds to the linear functional formula indicating the relationship between the pulse width and the remaining amount of toner in the printing mode A in FIG. 6. In this case, the first coefficient information is ($-a$), and the first intercept information is d. The coefficient information ($-a$) and the intercept information (d) are data for the second calculating processing. Further, in the linear functional formula between the printing mode A and the printing mode B or C in FIGS. 10 and 11, a formula ($Y=bX-\alpha$) corresponds to the linear functional formula shown in FIG. 10 indicating the relationship between the pulse width in the printing mode A and the pulse width in the printing mode B. A formula ($Y=cX-\beta$) corresponds to the linear functional formula shown in FIG. 11 indicating the relationship between the pulse widths in the printing mode A and the pulse width in the printing mode C. Then, the second coefficient information is b, the third coefficient information is c, the second intercept information is $\alpha$, and the third intercept information is $\beta$. The coefficient information b and c and the intercept information $\alpha$ and $\beta$ are data for the first calculating processing. The coefficient information and the intercept information are stored in the predetermined storage areas in the memory unit 55 and are read and used upon detecting the remaining amount of toner.

Thus, the toner or the photosensitive drum serving as the member forming the processing cartridge 7 is changed, thereby changing the relationship between the pulse width and the remaining amount of toner. Even then, it is possible to keep the precision for detecting the remaining amount of toner by changing the coefficient information and the intercept information in the memory unit 55 without changing the image forming apparatus 100.

According to the present embodiment, the two different printing modes (½ velocity mode and ⅓ velocity mode) with the basic printing mode (normal velocity mode) are used as the examples. The number of different printing modes may be greater than two. In accordance with the number of different printing modes, it is possible to increase the number of coefficient information and the number of intercept information which are stored in the memory unit 55.

According to the embodiment, the pulse widths in the ½ velocity mode and ⅓ velocity mode are corrected (converted) to the pulse width in the normal velocity mode and then the operation is controlled based on the corrected pulse widths so that the remaining amount of toner is obtained. The present invention is not limited to this and the remaining amount of toner may be obtained based on the relational formula between the pulse width and the remaining amount of toner in the printing mode shown in FIG. 6 (inclination information and intercept information).

Further, according to the present embodiment, the processing circuit in the CPU 81 executes the control operation. The present invention is not limited to this. The processing circuit is arranged independently of the CPU 81 and a control unit comprising the CPU 81 and the processing circuit on a single substrate may execute the control operation.

OTHER EMBODIMENTS

The color image forming apparatus according to another embodiment comprises the processing cartridges 7*a* to 7*d* which contain therein the toners of yellow, magenta, cyan, and black. Even when the toners of the colors are stirred at the same stirring velocity, the fluidity varies. The memory units arranged to the processing cartridges store information on the color toner property (fluidity), thereby precisely detecting the remaining amount of toner in accordance with the difference in color toner property (fluidity) in the printing modes.

Figure 13:
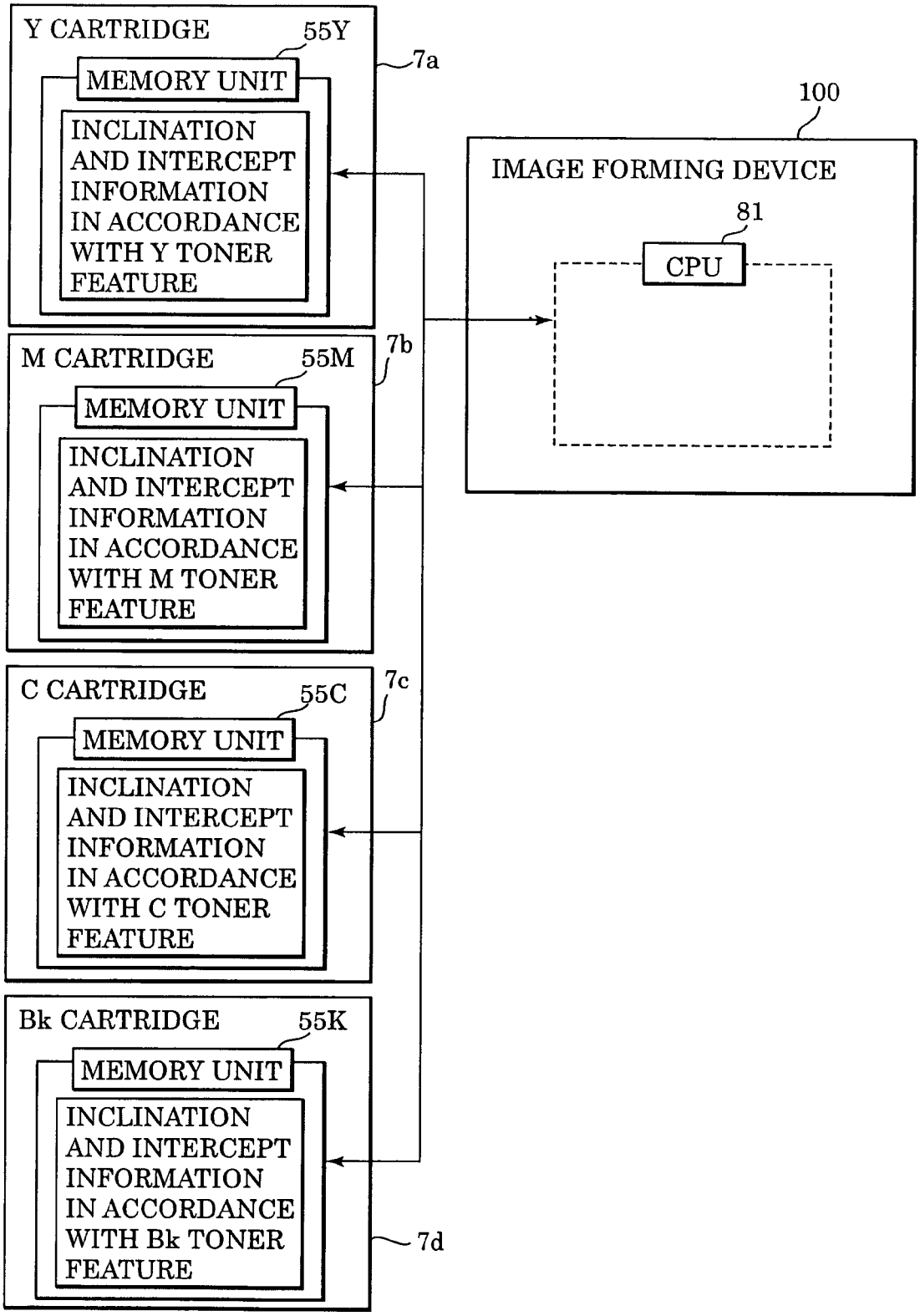
FIG. 13 is a block diagram showing a relationship between the image forming apparatus and the memory unit according to another embodiment of the present invention.

Referring to FIG. 13, the CPU 81 of the image forming apparatus 100 main body can be communicated with the memory unit 55 (55Y, 55M, 55C, and 55K) arranged to a yellow cartridge (Y cartridge), a magenta cartridge (M cartridge), a cyan cartridge (C cartridge), and a black cartridge (Bk cartridge) serving as the processing cartridge attached to the image forming apparatus 100. The memory unit 55 (55Y, 55M, 55C, and 55K) stores the inclination information and the intercept information in accordance with the color toner property (fluidity). The detail of the memory area in memory unit 55 is the same as the memory area shown in FIG. 12.

The information in accordance with the color toner property (fluidity) includes the coefficient information and intercept information for the first calculating processing for converting the data on the pulse width in accordance with the color toner fluidity into the data on the pulse width in the normal velocity mode, and the coefficient information and intercept information for the second calculating processing for calculating the remaining amount of toner from the pulse width in the normal velocity mode. As the coefficient information and intercept information for the first calculating processing, the values corresponding to a plurality of processing velocities of the image forming apparatus are stored similarly to the above embodiment. The CPU 81 in the image forming apparatus main body 100 reads the information and executes the first calculating processing and the second calculating processing in accordance with the color toner property, thereby detecting the remaining amounts of toners of the color processing cartridges with high accuracy.

According to the above-mentioned embodiment and other embodiments, the first calculating processing is performed to convert the pulse widths detected in the image forming velocities of ½ velocity mode and ⅓ velocity mode into the pulse widths in the normal velocity mode (printing mode A). The present invention is not limited to this. The inclination information and intercept information may be stored as information indicating the linear function (refer to FIG. 6) between the pulse width and the remaining amount of toner corresponding to the ½ velocity mode (printing mode B) and ⅓ velocity mode (printing mode C). Based on the stored inclination information and the intercept information, the remaining amounts of toner may be calculated in the ½ velocity mode and ⅓ velocity mode.

According to the present invention, even if a plurality of operating modes are frequently switched in the image formation, the remaining amount of developing agent can be detected with high precision and the information on the remaining amount of developing agent can be provided to the user with the high precision.

Further, the memory unit 55 is provided for the cartridge, which is detachable to the image forming apparatus. The information for the above-mentioned calculating processing is stored in the memory unit 55. Thus, even if the cartridge is changed, only the storage contents of the memory unit 55 in the cartridge may be changed without changing the specification of the image forming apparatus main body 100.

Further, a plurality of cartridges detachable to the image forming apparatus comprise memory units, and the information for the above-mentioned calculating processing is stored in the memory units in the cartridges in accordance with the color toner fluidity. Thus, it is possible to detect the remaining amount of toner in accordance with the color toner fluidity with high precision.

The present invention is not limited to the above embodiments and includes any modification of the same essentials.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application Nos. 2003-399882 filed on Nov. 28, 2003 and 2004-312302 filed on Oct. 27, 2004, which are hereby incorporated by reference herein.

What is claimed is:

1. An image forming apparatus having a first operating mode and a second operating mode having an image forming velocity different from that in the first operating mode, said image forming apparatus, comprising:

a developing-agent containing portion that contains a developing agent;

an optical developing-agent amount detecting unit that detects the amount of developing agent in the developing agent containing portion;

a processing unit configured to obtain the amount of developing agent based on data on the amount of developing agent detected by the developing-agent amount detecting unit; and a storing unit that stores information for correcting data on the amount of developing agent detected by the developing-agent amount detecting unit in the second operating mode, wherein the processing unit corrects the data on the amount of developing agent detected by the developing-agent amount detecting unit in the second operating mode based on the information stored in the storing unit, and obtains the amount of developing agent based on the corrected data.

2. An image forming apparatus according to claim 1, wherein the storing unit stores information indicating a relationship between the corrected data and the amount of developing agent, and the processing unit obtains the amount of developing agent based on the information stored in the storing unit.

3. An image forming apparatus according to claim 1, wherein the processing unit obtains the amount of developing agent based on the data obtained by statistical processing using a plurality of pieces of corrected data.

4. An image forming apparatus according to claim 1, wherein information indicating a linear functional formula is information indicating a relationship between the data on the amount of developing agent detected by the developing-agent amount detecting unit in the first operating mode and the data on the amount of developing agent detected by the developing-agent amount detecting unit in the second operating mode.

5. An image forming apparatus according to claim 2, wherein the information indicating a relationship between the corrected data and the amount of developing agent is information indicating a linear functional formula.

6. An image forming apparatus according to claim 1, wherein the second operating mode is a mode for forming an image at an image forming velocity slower than that of the first operating mode.

7. An image forming apparatus according to claim 1, wherein the optical developing-agent amount detecting unit includes a light emitting portion and a light receiving portion.

8. An image forming apparatus according to claim 1, wherein a cartridge integrally including the developing-agent containing portion and the storing unit is detachably mounted to the image forming apparatus.

9. An image forming apparatus according to claim 1, wherein the information stored in the storing unit is information in accordance with the property of the developing agent contained in the developing-agent containing portion.

10. A developing-agent amount detecting method of an image forming apparatus for forming an image in a first operating mode and an image in a second operating mode having an image forming velocity different from that in the first operating mode comprising a developing-agent containing portion containing a developing agent, an optical developing-agent amount detecting unit configured to detect the amount of developing agent in the developing-agent containing portion, and a storing unit configured to store data on the amount of developing agent detected by the developing-agent amount detecting unit in the second operating mode, the developing-agent amount detecting method comprising:

a correcting step of correcting the data on the amount of developing agent detected by the developing-agent amount detecting unit in said second operating mode based on the information stored in the storing unit; and a calculating step of obtaining the amount of developing agent based on the data corrected in the correcting step.

11. A developing-agent amount detecting method according to claim 10, wherein the storing unit stores information on a relationship between the corrected data and the amount of developing agent, and the calculating step obtains the amount of developing agent based on the information stored in the storing unit.

12. A developing-agent amount detecting method according to claim 10, wherein the calculating step performs statistical processing by using a plurality of corrected data and obtains the amount of developing agent from the obtained data.

13. A developing-agent amount detecting method according to claim 10, wherein the second operating mode is a mode for forming an image at an image forming velocity slower than that of the first operating mode.

14. A cartridge being detachably mountable to an image forming apparatus, the image forming apparatus having a first operating mode and a second operating mode having an image forming velocity different from that in the first operating mode, and the apparatus comprising an optical developing-agent amount detecting unit configured to detect the amount of developing agent in a developing-agent containing portion for containing a developing agent, said cartridge comprising:

the developing-agent containing portion; and a storage medium comprising a storage area that stores information for correcting the data on the amount of developing agent detected by the developing-agent amount detecting unit in the second operating mode.

15. A cartridge according to claim 14, wherein said image forming apparatus further comprises a processing unit that corrects the data on the amount of developing agent detected by said developing-agent amount detecting unit in the second operating mode, and the storage medium further comprises a storage area, that stores information indicating a relationship between the amount of developing agent and the data on the amount of developing agent detected by said developing-agent amount detecting unit that is corrected.

16. A cartridge according to claim 14, wherein the information for correcting the data on the amount of developing agent detected by the developing-agent amount detecting unit in the second operating mode is information indicating a linear functional formula.

17. A cartridge according to claim 15, wherein the information indicating a relationship between the amount of developing agent and the data on the amount of developing agent detected by said developing-agent detecting unit that is corrected is information indicating a linear functional formula.

18. A cartridge according to claim 14, wherein the second operating mode is a mode for forming the image at an image forming velocity slower than that of the first operating mode.

19. A cartridge according to claim 14, wherein the cartridge includes at least a photosensitive member, a charging unit that charges the photosensitive member, a developing unit that develops an electro-static image on the photosensitive member, and a cleaning unit that cleans the photosensitive member.

20. A cartridge according to claim 14, wherein the information stored in the storage medium is information in accordance with the property of the developing agent contained in the developing-agent containing portion.

21. A storage medium mounted on a cartridge usable with an image forming apparatus having a first operating mode and a second operating mode having an image forming velocity different from that in the first operating mode, the image forming apparatus comprising an optical developing-agent amount detecting unit configured to detect the amount of developing agent in a developing-agent containing portion for containing a developing agent, the storage medium comprising:

a storage area that comprises a storage area for storing information for correcting data on the amount of developing agent detected by the developing-agent amount detecting unit in the second operating mode.

22. A storage medium according to claim 21, wherein the image forming apparatus further comprises a processing unit configured to correct the data on the amount of developing agent detected by the developing-agent amount detecting unit in the second operating mode, and wherein the storage area further includes a storage area that stores information indicating a relationship between the amount of developing amount and the data corrected by the developing-agent amount detecting unit.

23. A storage medium according to claim 21, further comprising:

a storage area that stores information on the amount of developing agent.

24. A storage medium according to claim 21, wherein the information for correcting the data on the amount of developing agent detected by the developing-agent amount detecting unit in the second operating mode is information indicating a linear functional formula.

25. A storage medium according to claim 22, wherein the information indicating the relationship between the corrected data and the amount of developing amount is information indicating a linear functional formula.

26. A storage medium according to claim 21, wherein the second operating mode is a mode for forming the image at an image forming velocity slower than that in the first operating mode.

27. A storage medium according to claim 21, wherein the cartridge includes a developing-agent containing portion that contains the developing agent.

28. A storage medium according to claim 21, wherein the information stored in the storage medium is information in accordance with the property of the developing agent contained in the developing-agent containing portion.

* * * * *